US010203083B2

(12) United States Patent
Lin

(10) Patent No.: US 10,203,083 B2
(45) Date of Patent: Feb. 12, 2019

(54) LAMP SHADE

(71) Applicant: Chien-Ting Lin, Taipei (TW)

(72) Inventor: Chien-Ting Lin, Taipei (TW)

( * ) Notice: Subject to any disclaimer, the term of this patent is extended or adjusted under 35 U.S.C. 154(b) by 0 days.

(21) Appl. No.: 15/634,209

(22) Filed: Jun. 27, 2017

(65) Prior Publication Data

US 2018/0119920 A1 May 3, 2018

(30) Foreign Application Priority Data

Nov. 3, 2016 (CN) ..... 2016 2 1178291 U

(51) Int. Cl.
*F21V 1/06* (2006.01)
*F21V 7/00* (2006.01)

(52) U.S. Cl.
CPC . *F21V 1/06* (2013.01); *F21V 7/00* (2013.01)

(58) Field of Classification Search
CPC ..... F21V 1/06; F21V 7/00; F21V 1/143
See application file for complete search history.

(56) References Cited

U.S. PATENT DOCUMENTS 6,709,121 B1 * 3/2004 Lowe ..... G03B 15/06 362/18
6,733,145 B2 * 5/2004 Shirilla ..... F21V 7/18 362/16
7,416,316 B2 * 8/2008 O'Brien ..... F21V 7/18 362/10
7,497,602 B2 * 3/2009 Lien ..... F21V 1/06 362/352
8,833,951 B1 * 9/2014 Pavlenko ..... G03B 15/06 135/135
8,931,931 B2 * 1/2015 Yoo ..... F21V 7/22 362/16

* cited by examiner

*Primary Examiner* — Peggy A Neils
(74) *Attorney, Agent, or Firm* — Muncy, Geissler, Olds & Lowe, P.C.

(57) ABSTRACT

A lamp shade, comprising a multi-axis carrier; a plurality of support bars being pivotally connected to the multi-axis carrier to be pivotable between an open-up position and a folded position, the pivot axes of the plurality of support bars being parallel to each other or coaxial; and a cloth member mounted on the plurality of support bars, having an opening portion whose two corresponding sides being provided with two fastening elements; wherein when the support bars pivotally rotated to radially distribute is in the open-up position, the fastening elements is in the connected position, so as to the cloth member be extended to form a lampshade by a plurality of support bars, and by separating the fastening elements the plurality of support bars reversely pivot to be close to each other in the folded position so as to the cloth member co-pivot and fold.

10 Claims, 20 Drawing Sheets

LAMP SHADE

FIELD OF THE INVENTION

The present invention relates to a lamp shade, and more particularly relates to a lamp shade for photography.

BACKGROUND OF THE INVENTION

Photography is an imaging process that uses light to form an image as a photography work. Therefore, light is very important for photography. A professional photography generally requires to use a lamp with a lamp shade to provide a more proper and delicate light to an object to be photographed. Therefore, a professional photographer usually carries a lamp shade with a lamp as carry-on items to obtain photography with best light quality.

A conventional lamp shade is generally provided as a one-piece object, however which is with drawback of volume being too large and causing difficulty for carriage. Alternatively, there is another kind of lamp shade that comprises a plurality of detachable elements including an upper cover, an outer frame, supporting rods and shade edge supporting rods, which can be separately disassembled. It is with advantage in volume reduction, but it is with another disadvantage that reassembles these items are required. The drawback may causes inefficiency and the items lost during the transportation.

Furthermore, a conventional lamp shade, such as an umbrella type lamp shade is with an umbrella structure as a bracket, comprises a plurality of long rib elements, short rib elements, a center shaft and connecting elements. The producing processes are complicate and require complicate umbrella producing equipments. In spite that a small umbrella type lamp shade is convenient for storage and usage, a large umbrella lamp shade is heavy weight and is with a long center shaft so that it is inconvenient.

SUMMARY OF THE INVENTION

In view of the above, the conventional lamp shade in a prior art has drawbacks including carriage inconvenience, items lost, time-consuming for detaching and assembling, producing processes complicate and inconvenience in use. Therefore, an improvement is required.

Accordingly, in order to solve the problems of the conventional art, it is one object of the present invention to provide a lamp shade which is easy to carry, easy to remove and does not need to be repeatedly assembled or disassembled.

Therefore, the present invention overcomes the technical problems in the conventional art and provides a lamp shade, comprising: a multi-axis carrier; a plurality of support bars, one end of each support bar being pivotally connected to the multi-axis carrier so as to be pivotable between an open-up position and a folded position in relation to the multi-axis carrier, pivot axes of the plurality of support bars being substantially parallel to each other or being coaxial, wherein, in the open-up position, the plurality of support bars are pivotally rotated to radially distribute and, in the folded position, the plurality of support bars are pivotally rotated to be close to each other; and a cloth member, mounted on the plurality of support bars, having an opening portion which extends from a peripheral edge of the cloth member toward an inner center of the cloth member, and two corresponding sides of the opening portion being respectively provided with two fastening elements, the two fastening elements being configured to be connected or separated with each other to close or open the opening portion, wherein the cloth member is expanded by the plurality of support bars to form a lampshade when the support bars are in the open-up position and the fastening elements are connected, and the cloth member mounted on the plurality of support bars is folded by enabling the plurality of support bars to reversely pivotal move from the two corresponding sides of the opening portion so as to move the plurality of support bars from the open-up position to the folded position when the fastening portions are separated from each other to open the opening portion.

According to an embodiment of the present invention, a lamp connector that connects with a lamp, the lamp connector is provided to fix on the multi-axis carrier.

According to an embodiment of the present invention, the respective pivot axes of the plurality of support bars are provided in parallel and surround a center of the multi-axial carrier, and side edges of the plurality of support bars get closed to each other so as to get the plurality of support bars folded.

According to an embodiment of the present invention, the center of the multi-axial carrier is provided with a lamp installation opening where a lamp is installed.

According to an embodiment of the present invention, a plurality of pivoting limiters protruding from a surface of the multi-axis carrier so as to resist against the support bars when the support bars are at the folded position and/or the open-up position and limit the support bars in positions between the folded position and the open-up position.

According to an embodiment of the present invention, an amount of axis which is coaxial by the pivot axes of the plurality of support bars is at least one, and the axis which is coaxial by the pivot axes of the plurality of support bars is parallel to the other pivot axes.

According to an embodiment of the present invention, the pivot axes of the plurality of support bars are provided coaxially in such a manner that the plurality of support bars are vertically stacked to each other to pivotally connect to the multi-axial carrier, and wherein, in the folded position, an upper surfaces and bottom surfaces of the plurality of support bars get closed to each other so as to get the plurality of support bars closed.

According to an embodiment of the present invention, the multi-axial carrier is provided as a part of a lamp.

According to an embodiment of the present invention, each of the support bars includes a strengthening portion and a bar portion, one end of the strengthening portion is pivotally connected to the multi-axial carrier and the other end of the strengthening portion is sleeved on or in crimp connection with one end of the bar body portion to form the support bar together with the bar body portion.

According to an embodiment of the present invention, each of the support bars includes a strengthening portion and a bar body portion, one end of the strengthening portion is pivotally connected to the multi-axial carrier and the other end of the strengthening portion is sleeved on or in crimp connection with one end of the bar body portion to form the support bar together with the bar body portion, and said the other end of the bar body portion are collectively and pivotally connected to the multi-axial carrier together with the strengthening portion.

Via the technical means adopted by the present invention, the usage of the lamp shade of the present application is convenient since, in a folding process, it only requires to separate the opening portion of the cloth member and pivot the support bars to fold the lamp shade to the folded position, and in an expanding process it only requires to pivot the support bars to expand the lamp shade to the open-up position and then close the opening portion. Therefore, a user can conveniently use the lamp shade of the present invention such that the purposes of volume reduction for storage and easy carriage can be easily achieved.

DETAILED DESCRIPTION OF THE PREFERRED EMBODIMENTS

Figure 1:
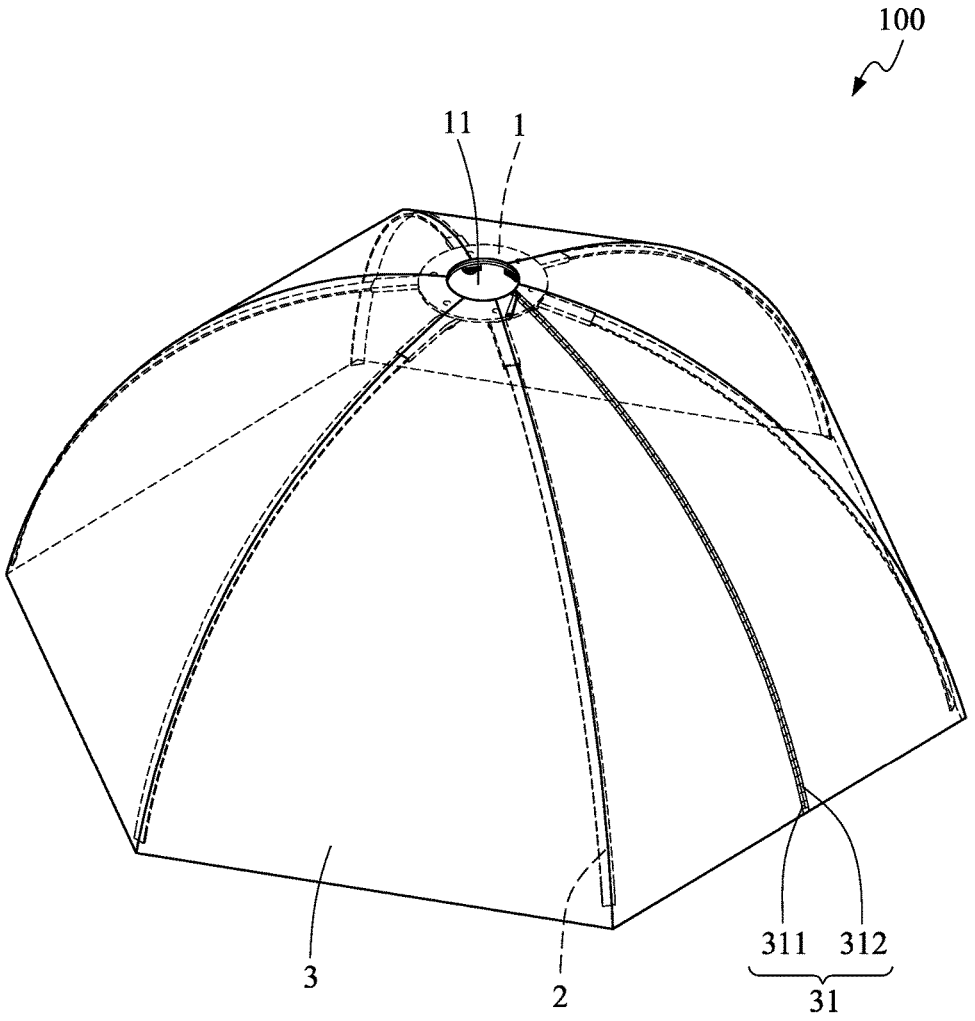
FIG. 1 is a schematic stereogram illustrating a lamp shade according to one embodiment of the present invention in which the respective pivot axes of a plurality of support bars are provided in parallel.

The preferred embodiments of the present invention are described in detail below with reference to FIG. 1 to FIG. 9D. The description is used for explaining the embodiments of the present invention only, but not for limiting the scope of the claims.

As shown in FIG. 1 to FIG. 6, a lamp shade 100 according to one embodiment of the present invention, which is provided for mounting a lamp L thereon to adjust the illumination area of the lamp L, as shown in FIGS. 5A to 5E, and FIGS. 9A to 9D, includes: a multi-axis carrier 1; a plurality of support bars 2, one end of each support bar 2 being pivotally connected to the multi-axis carrier 1 so as to be pivotable between an open-up position and a folded position in relation to the multi-axis carrier 1, pivot axes of the plurality of support bars 2 being substantially parallel to each other, as shown in FIG. 1 to 5E, or being coaxial, as shown in FIGS. 6 to 9D, wherein, in the open-up position, the plurality of support bars 2 are pivotally rotated to radially distribute and, in the folded position, the plurality of support bars 2 are pivotally rotated to be close to each other; and a cloth member 3, mounted on the plurality of support bars 2, having an opening portion 31 which extends from a peripheral edge of the cloth member 3 toward an inner center of the cloth member 3, and two corresponding sides of the opening portion 31 being respectively provided with two fastening elements 311, 312.

Figure 4A:
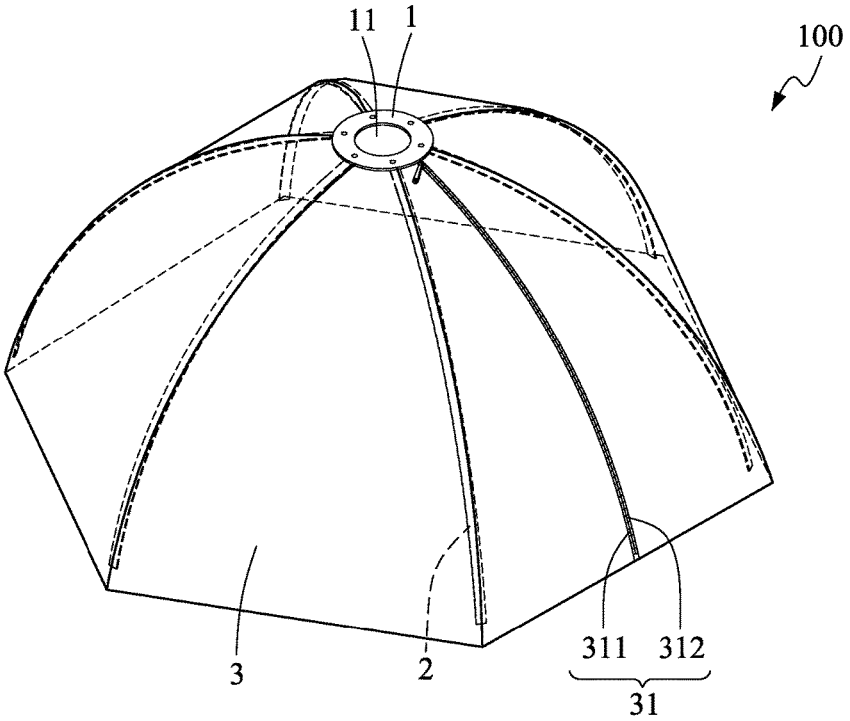
FIG. 4A to 4D is a using schematic illustrating a lamp shade according to one embodiment of the present invention in which the respective pivot axes of the plurality of support bars are provided in parallel.
Figure 4B:
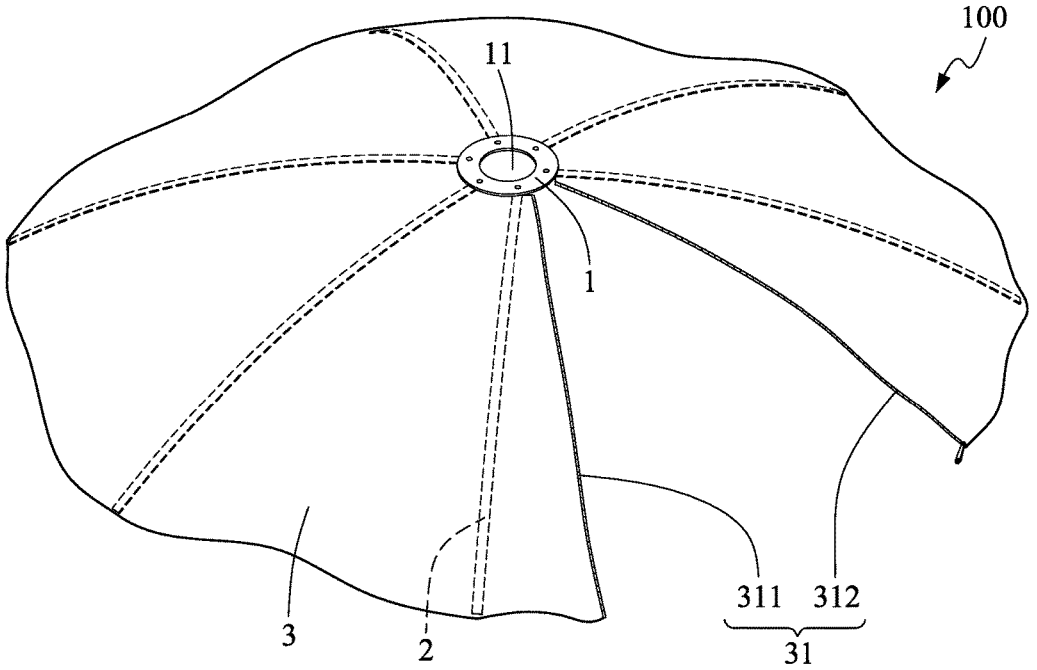
Figure 4C:
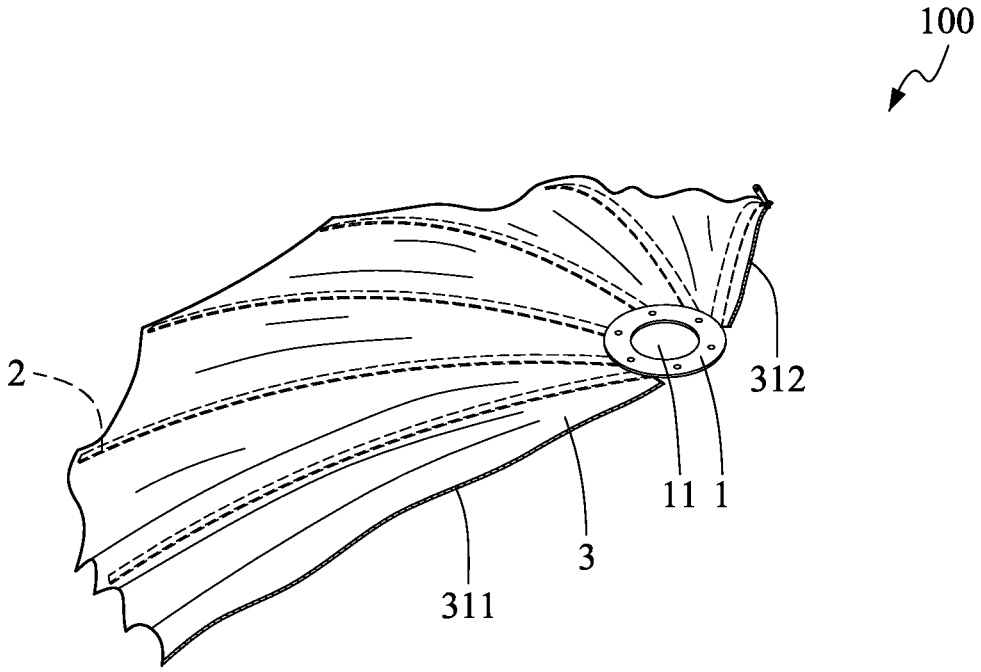
Figure 4D:
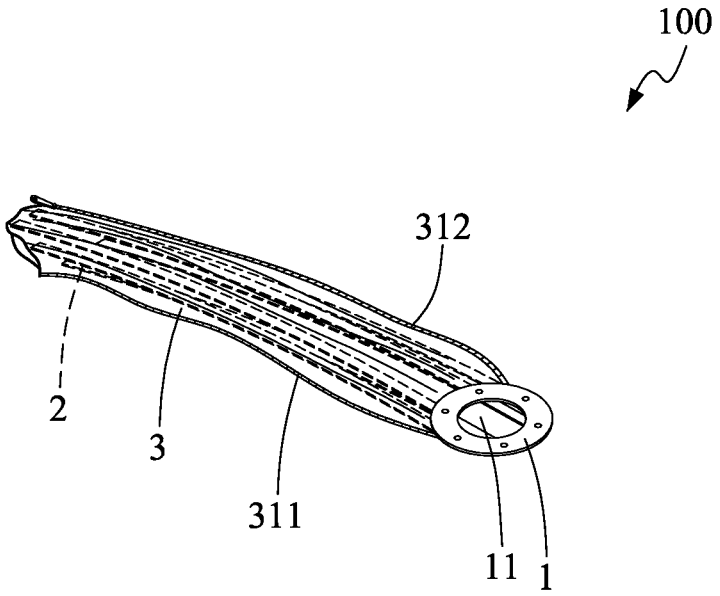
Figure 8A:
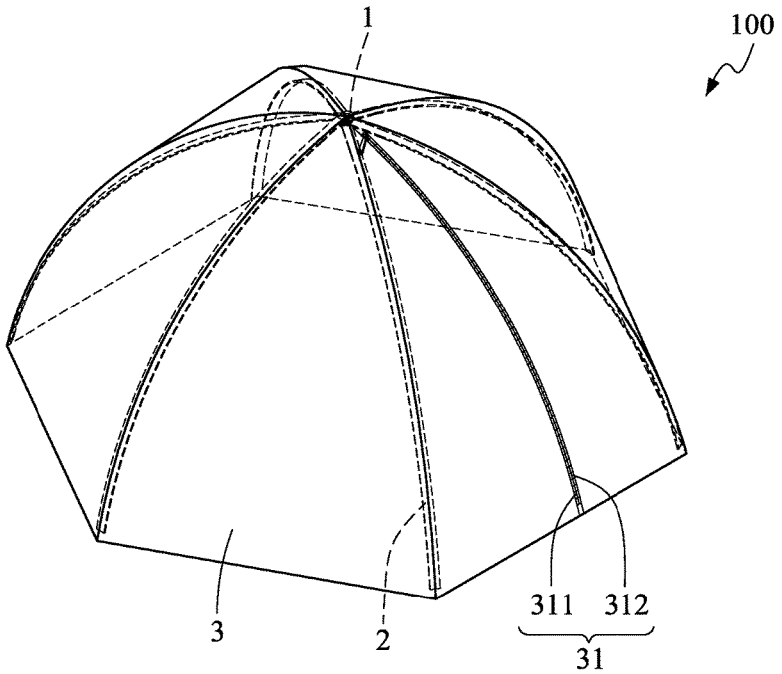
FIGS. 8A to 8D is a using schematic illustrating a lamp shade according to one embodiment of the present invention in which the pivot axes of the plurality of support bars are provided coaxially.
Figure 8B:
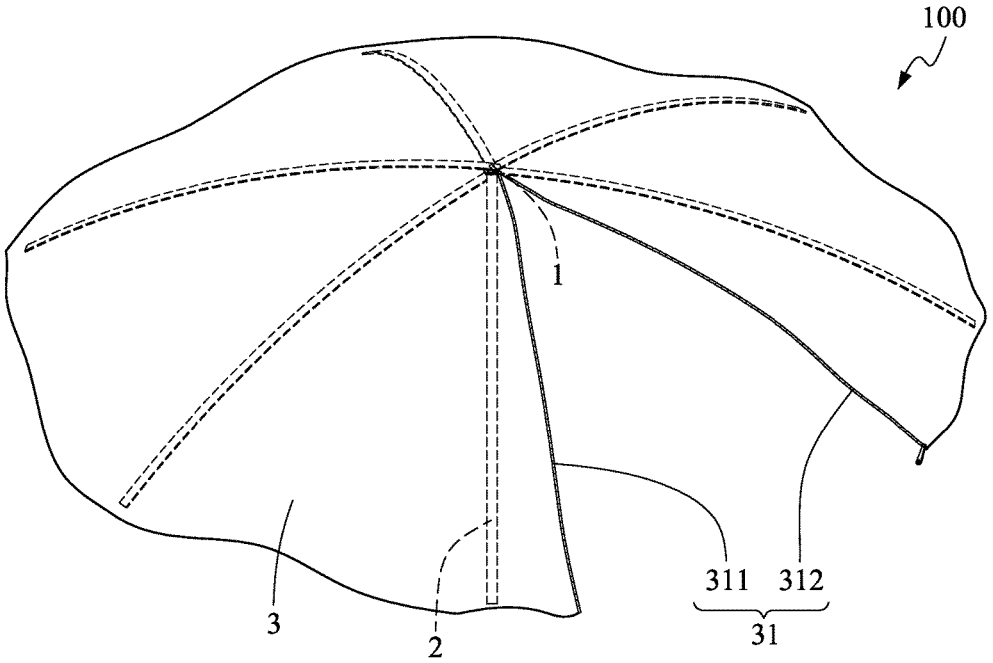
Figure 8C:
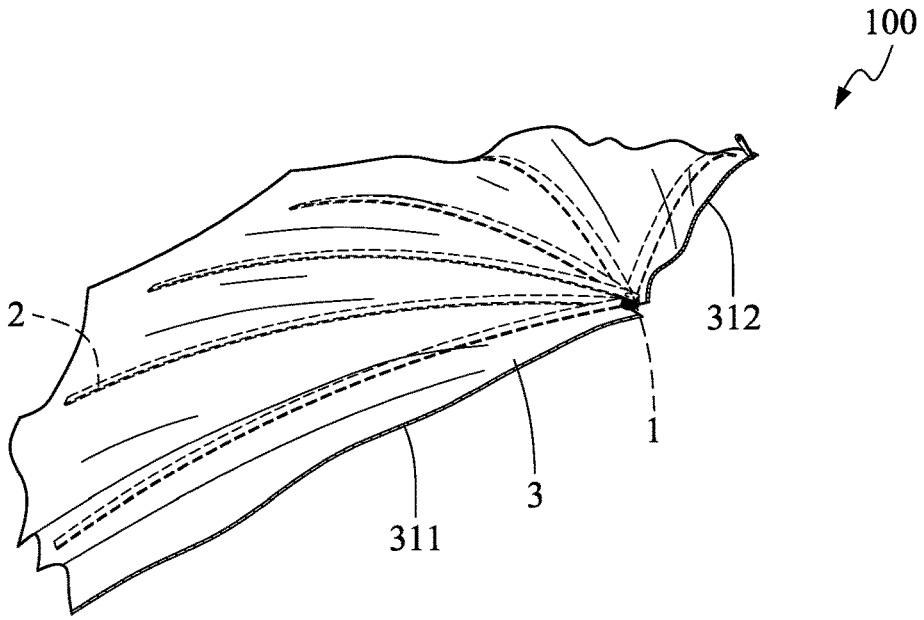
Figure 8D:
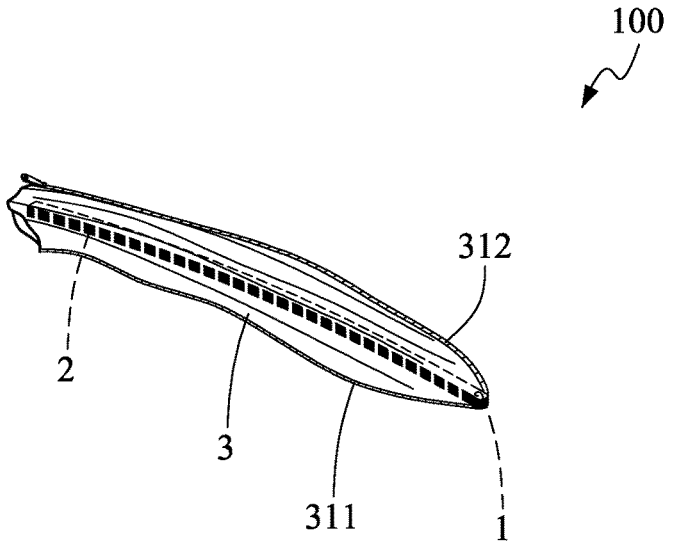

As shown in FIG. 4A to FIG. 4D and FIG. 8A to FIG. 8D, the lamp shade 100 has an open-up form and a folded form. When the lamp shade 100 is in the unfolded form, the plurality of support bars 2 are pivoted to the open-up position to expand into a radial distribution, as shown in FIGS. 4A and 8A, the cloth member 3 is pivoted together with the plurality of support bars 2 to the open-up position, and the opening portion 31 can be closed by connecting the fastening elements 311, 312, so that the cloth member 3 is expanded by the plurality of support bars 2 to form a lampshade. The lamp shade 100 then can be transferred to the folded form by separating the two fastening elements 311, 312 to open the opening portion 31 to the open-up position, and reversely pivoting the plurality of support bars 2 from the two corresponding sides of the opening portion 31 in such a manner to gradually move the cloth member 3 together with the frame formed of the plurality of support bars 2 from the open-up position to the folded position, as shown in FIG. 4D and FIG. 8D, that is the position where side edges of the plurality of support bars 2 get closed to each other, so that the cloth members 3 mounted on the plurality of support bars 2 are collapsed with the cooperation of the plurality of support bars 2. The lamp shade 100 can be transferred from the folded form to the open-up form by reversing above operation.

Specifically, in the present invention, there are two arrangements of the plurality of support bars 2 being pivoted relative to the multi-axis carrier 1, one of the arrangements is that the pivot axes of the plurality of support bars 2 are parallel to each other, as shown in FIGS. 1 to 5E, and the other is that the axis of the plurality of support bars 2 are coaxial, as shown in FIGS. 6 to 9D.

In the case that the pivot axes of the plurality of support bars 2 are parallel to each other:

In the embodiment of FIGS. 1 to 5B according to the present invention, the multi-axial carrier 1 is a ring body having, in the center thereof, a lamp installation opening 11 for installing the lamp L. In another embodiment of the present invention, the multi-axial carrier 1 is a disk-like body having no perforations in the center, as shown in FIGS. 1 5D and 5E.

Figure 2A:
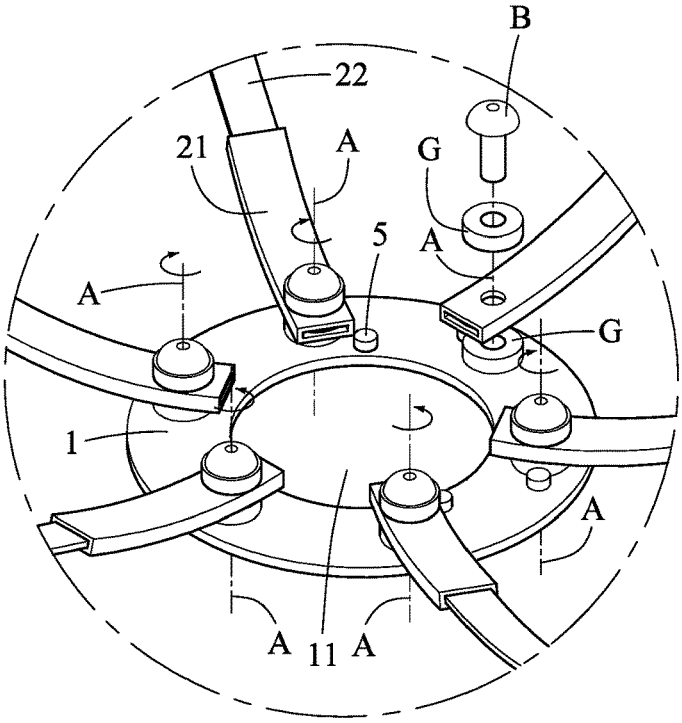
FIG. 2A is a partial schematic stereogram illustrating the lamp shade according to the embodiment of the present invention in which the respective pivot axes of the plurality of support bars are provided in parallel.
Figure 2B:
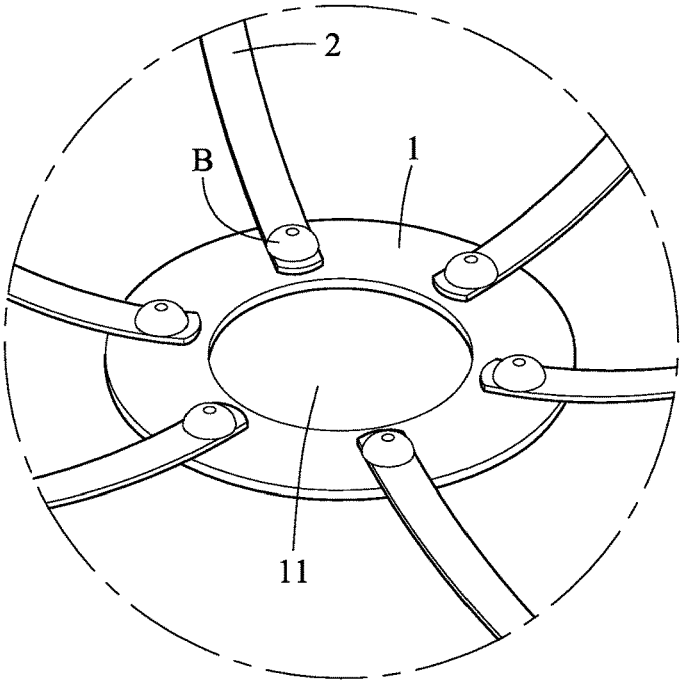
FIG. 2B to FIG. 2D is a partial schematic stereogram illustrating a lamp shade according to one embodiment of the present invention in which the respective pivot axes of the plurality of support bars are provided in parallel.
Figure 2C:
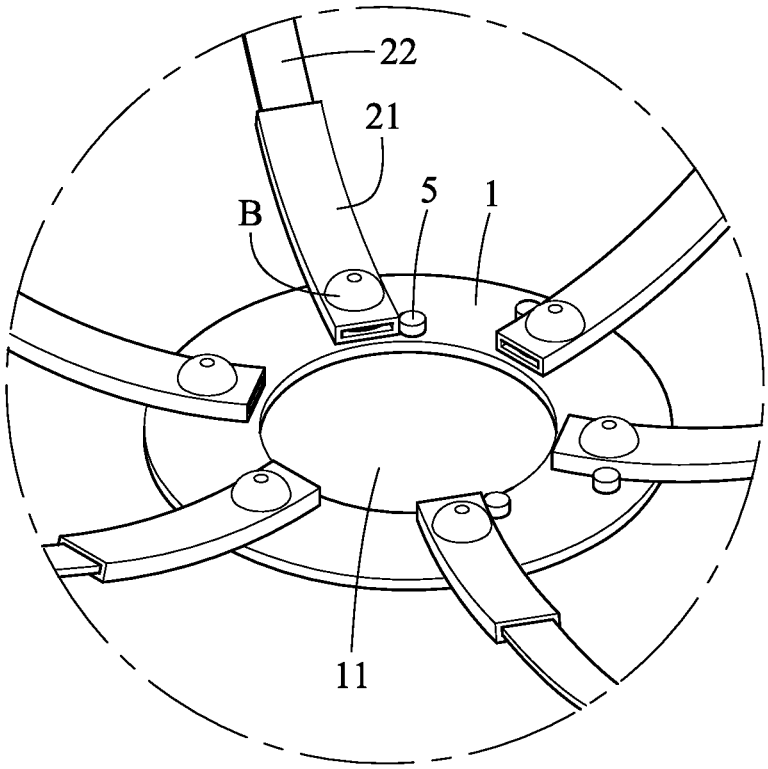
Figure 2D:
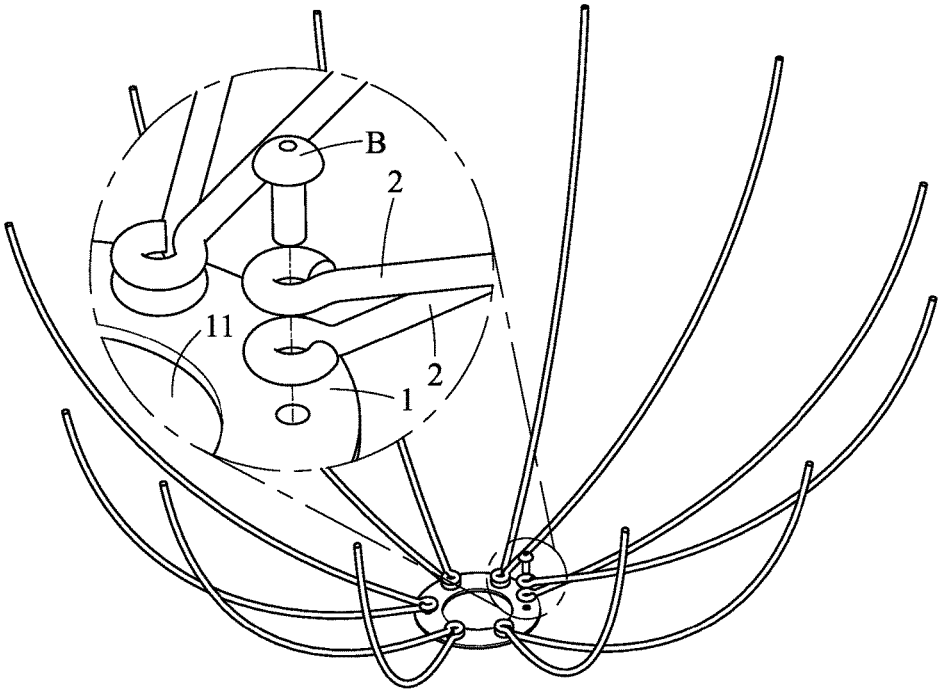

In the embodiment of FIGS. 2A to 2C, each of the support bars 2 is a long strip having a perforation at one end. In another embodiment of the present invention, as shown in FIG. 2D, each of the support bars 2 is a cylindrical bar having a perforation at one end. Each of the support bars 2 is pivotally connected to the multi-axial carrier 1 at one end thereof via a screw bearing B passing through the perforation of the support bar 2. However, the present invention is not limited to this and the support bar 2 may be pivotally connected to the multi-axial carrier 1 in other manners.

Preferably, as shown in FIG. 2A, a screw washer G is provided between each of the support bars 2 and the screw bearing B, and another screw washer G is provided between the support bar 2 and the multi-axis carrier 1 in such a manner to absorb a pressure between the support bar 2 and the screw bearing B and a pressure between the support bar 2 and the multi-axial carrier 1 so as to prevent the elements from contacting each other and being worn, and to reduce the contact area of pivoting to smooth the pivoting.

Figure 3:
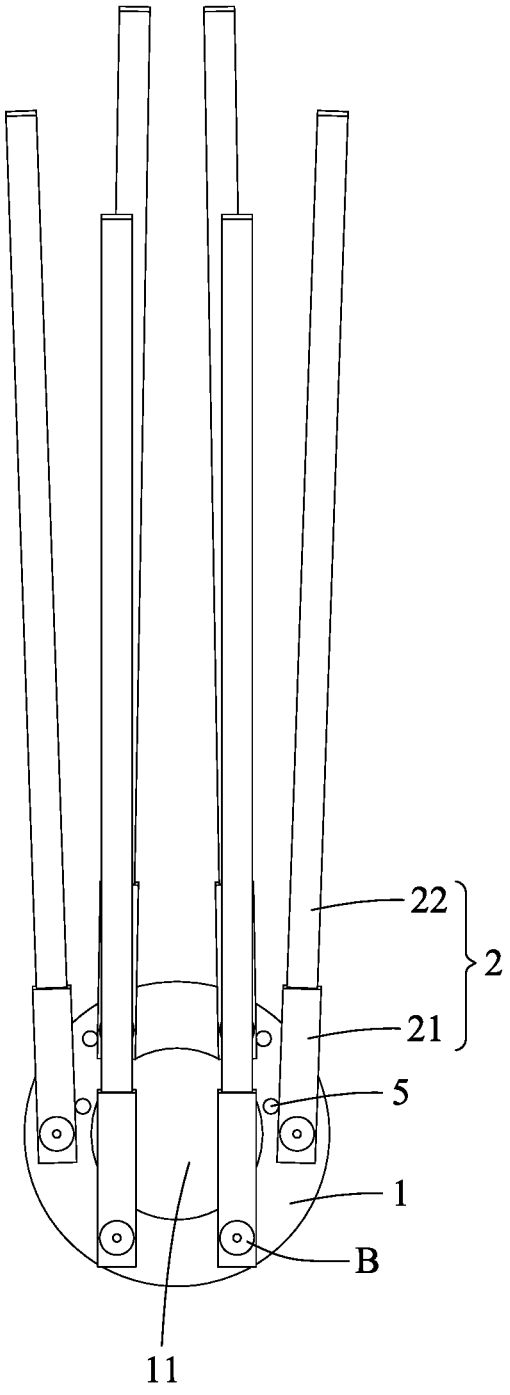
FIG. 3 is a partial plan view illustrating a lamp shade in a folded position according to one embodiment of the present invention in which the respective pivot axes of the plurality of support bars are provided in parallel.

In the embodiment shown in FIGS. 1 to 4D that the lamp installation opening 11 is provided at the center of the multiaxial carrier 1, the plurality of support bars 2 are pivotally connected at one end to the multi-axis carrier 1, and those pivotally connected ends are arranged surrounding the center of the multi-axis carrier 1 in a radially equidistant manner and surround a peripheral side of the lamp installation opening 11. However, the present invention is not limited to this, and the plurality of support bars 2 may be arranged surrounding only the center of the multi-axis carrier 1 in a radially equidistant manner while the multi-axis carrier 1 is not provided with the lamp installation opening 11. The plurality of support bars 2 may be arranged surrounding the center of the multi-axial carrier 1 in a non-equidistant manner depending on design requirements. The plurality of support bars 2 are pivoted to a surface of the multi-axis carrier 1 at the same side in such a manner that the pivoting ends of the plurality of support bars 2 are pivotable in a common plane, i.e., the pivot axes A are parallel to each other, as shown in FIG. 2A, and are pivotable on the vicinity of the lamp installation opening 11. The side edges of the plurality of support bars get closed to each other so as to get the plurality of support bars folded, as shown in FIG. 3.

In the embodiment shown in FIG. 2D, an amount of axis which is coaxial by the pivot axes of two or more support bars 2 is at least one, and is parallel to the other pivot axes. As shown in FIG. 2D of this case, the plurality of support bars 2 are twelve support bars 2 whose the pivot axes of a group of two support bars 2 are pivoted coaxially, and forms the axes of six coaxial axes, and the axes of the six coaxial axes are parallel to each other. Of course, the present invention is not so limited, and the pivot axes may be pivoted coaxially by different numbers (one or more) of the plurality of support bars 2 to parallel to another pivot axes, or may the pivot axes may be pivoted non-coaxially (a pivot axe only is pivoted by a support bars 2) and coaxially (the pivot axes are pivoted coaxially by a plurality of support bars 2) depending on the demand. Of course, the present invention is not so limited, and the pivot axes may be pivoted coaxially by different numbers (one or more) of the plurality of support bars 2 and be parallel to the other pivot axes, or the pivot axes may be pivoted by two kinds for non-coaxially (a pivot axe only is pivoted by a support bars 2) and coaxially (the pivot axes are pivoted coaxially by a plurality of support bars 2) that depends on the requirements.

Preferably, a plurality of pivoting limiters 5, as shown in FIG. 2A and FIG. 2C, are provided between one of the pivot ends of the plurality of support bars 2 on the multi-axis carrier 1 and the other pivot end. The plurality of pivoting limiters 5 protruding from a surface of the multi-axis carrier 1 so as to resist against the support bars 2 when the support bars 2 are at the folded position and/or the open-up position and limit the support bars 2 in positions between the folded position and the open-up position. In this folded position, as shown in FIG. 3, when the pivoting of the plurality of support bars 2 to the different side, the pivoting limiter 5 is against the pivoting of the support bars 2 so as to the plurality of support bars 2 only be pivoted on the same side and arranged close to each other of side edges. In the open-up position, as shown in FIG. 2C, the pivoting limiter 5 limits the pivoting of the plurality of support bars 2 when the plurality of support bars 2 are pivoted to a radial distribution.

In the case where the pivot axes of the plurality of support bars 2 are coaxial to each other:

In the embodiment of the present case, as shown in FIGS. 6 to 9D, the multi-axial carrier 1 is a screw bearing B. Each of the support bars 2 is a long strip having a perforation at one end. The multi-axial carrier 1, that is, the screw bearing B, is inserted into each of perforation of the support bars 2, so that the plurality of support bars 2 are stacked one above the other in order and are coaxially pivotally connected to the multi-axial carrier 1 at one end, as shown at FIG. 7A. Of course, the present invention is not so limited and the support bar 2 may be pivotally connected to the multi-axial carrier 1 in other manners. In the folded position, an upper surfaces and bottom surfaces of the plurality of support bars 2 get closed to each other so as to get the plurality of support bars 2 closed, as shown at FIG. 8D.

Preferably, as shown in FIGS. 2A to 2C and FIGS. 7A and 7B, the support bars 2 are long strips having a low thickness in a thickness direction thereof parallel to the pivot axes A, so that the support bars 2 are pivotable on the multi-axial carrier 1 with the thickness direction being parallel to the pivot axes A. And, in the folded position, either the pivot axes of the plurality of support bars are parallel or coaxial to each other, the plurality of support bars are pivotable with the low thickness direction to fold or stake to each other in such a manner that the overall volume of folded the lamp shade 100 is relatively small and easy to carry. Of course, the present invention is not limited to this, and the support bar 2 may be a cylindrical bar-shaped support bar.

Figure 7A:
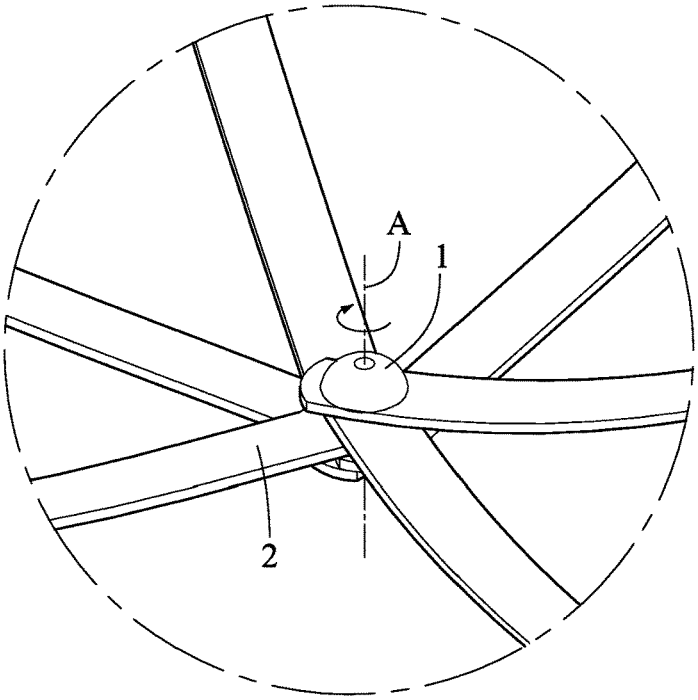
FIGS. 7A to 7B is a partial schematic stereogram illustrating a lamp shade according to one embodiment of the present invention in which the pivot axes of the plurality of support bars are provided coaxially.
Figure 7B:
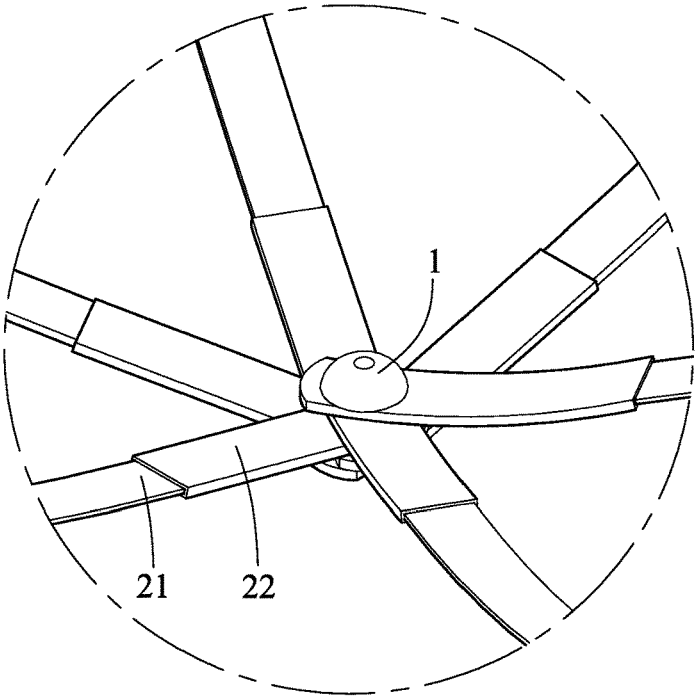

Preferably, as shown in FIG. 2A, FIG. 2C and FIG. 7B, each of the support bars 2 includes a strengthening portion 21 and a bar portion 22, one end of the strengthening portion 21 is pivotally connected to the multi-axial carrier 1 and the other end of the strengthening portion 21 is sleeved on or in crimp connection with one end of the bar body portion 22 to form the support bar 2 together with the bar body portion 22. In the present embodiment, one end of the bar portion 22 which is inserted into or pressed by the strengthening portion 21 is pivotally connected to the multi-axial carrier 1 with the strengthening portion 21, so that the end portion structure is stronger and less deformable, and more the bar portion 22 can be prevented from falling off the strengthening portion 21 in such a manner that the bar portion 22 is directly pivoted to the multi-axial carrier 1.

Figure 9A:
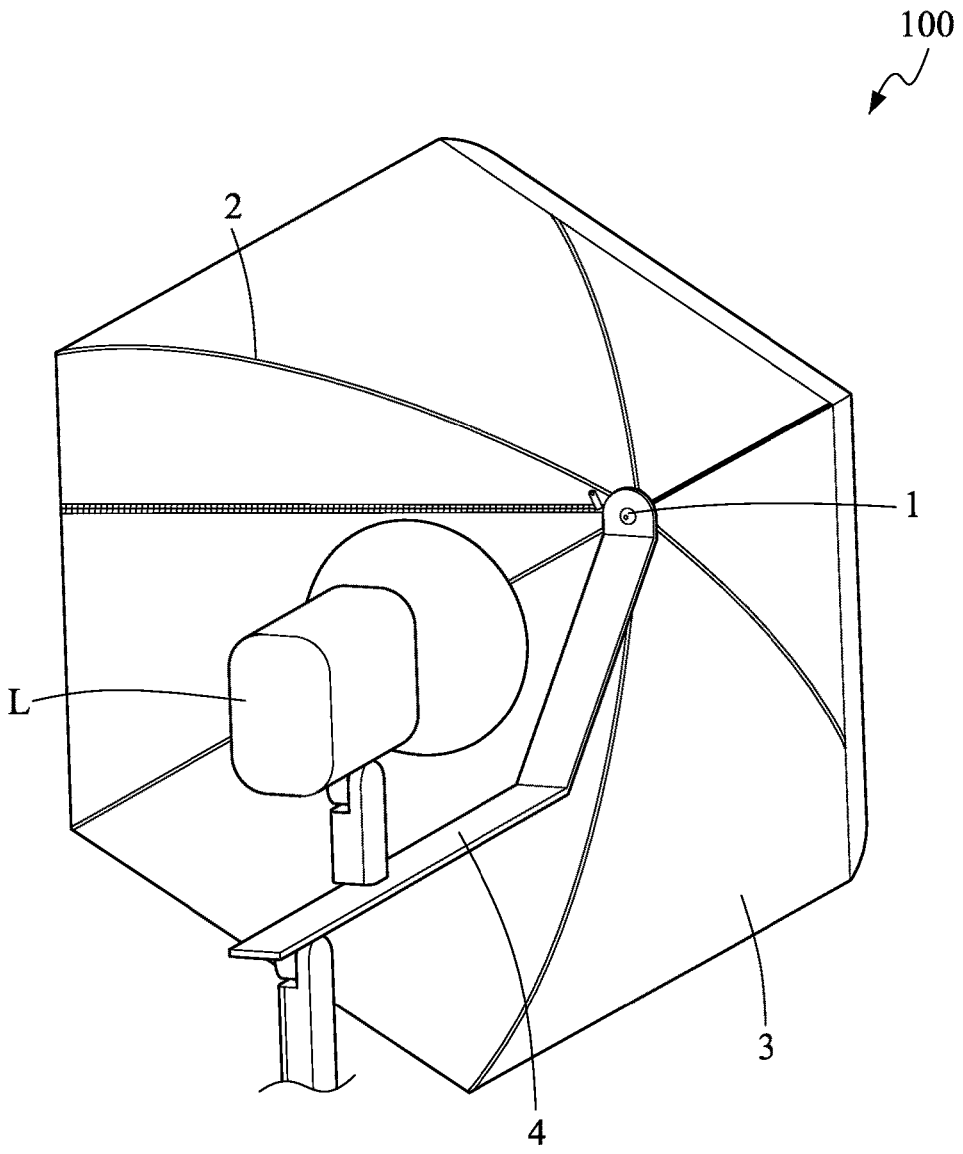
FIGS. 9A to 9D is a using schematic illustrating a lamp shade according to one embodiment of the present invention in which the pivot axes of the plurality of support bars are provided coaxially.
Figure 9B:
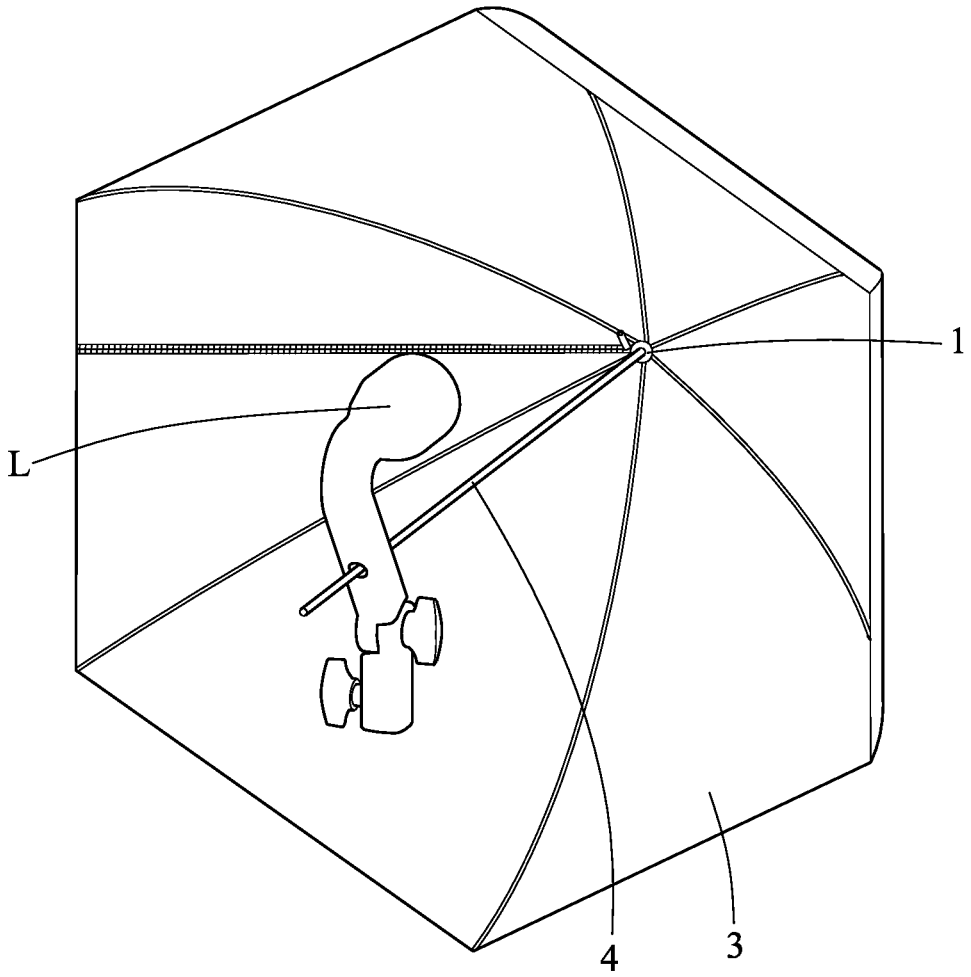
Figure 9C:
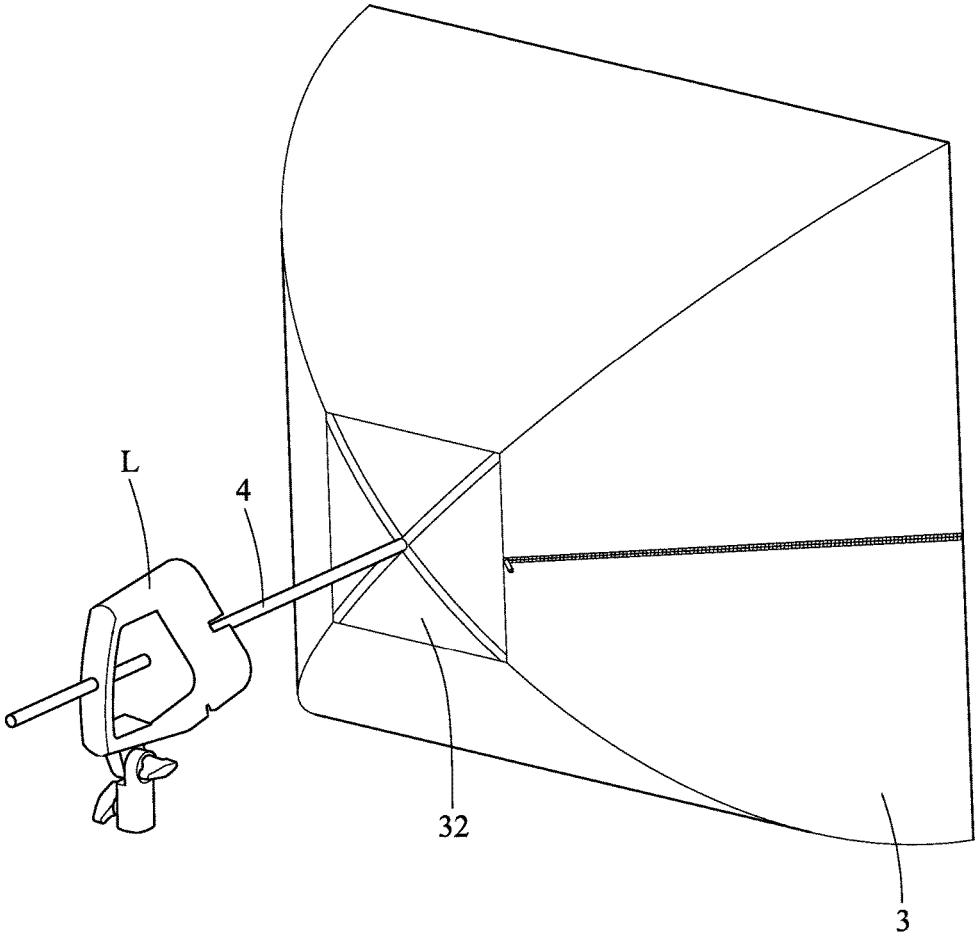
Figure 9D:
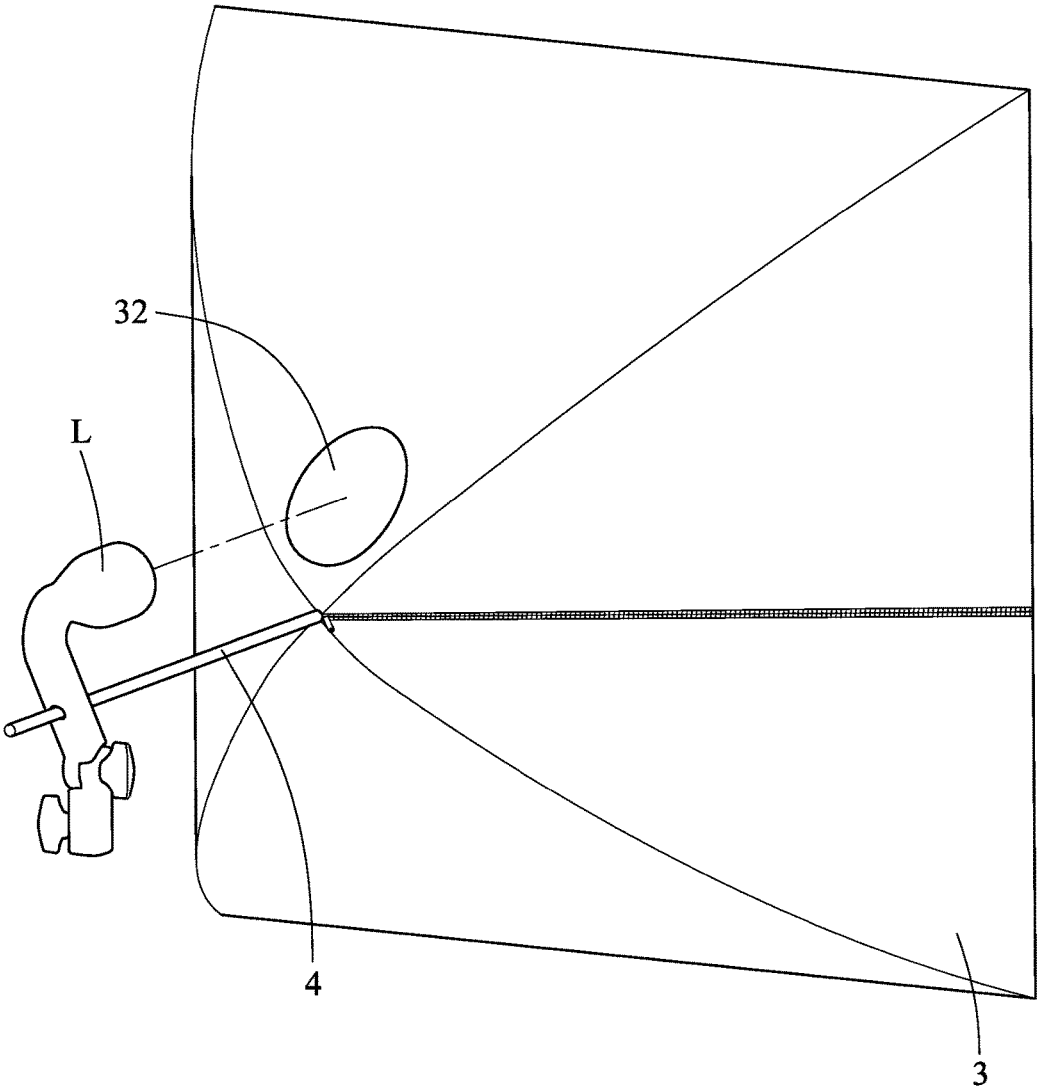

As shown in FIGS. 1 to 6, the fame formed by the cloth member 3 mounted on the plurality of support bars 2 and the plurality of support bars 2 is pivoted on the multi-axis carrier 1. In this embodiment, the cloth member 3 is a cloth having a light-reflecting surface for reflecting the light of the lamp L. Of course, the present invention is not limited to this, and the cloth member 3 may also be a semi-transparent cloth for transmitting the light of the lamp L. The cloth member 3 has the opening portion 31 opened and closed by the fastening elements 311, 312 and the opening portion 31 extends from the peripheral edge of the cloth member 3 toward an inner center to the top end of lampshade-like the cloth member 3, and the opening portion 31 is provided between the support bar 2 and the abutting support bar 2. The two corresponding sides of the opening portion 31 are respectively provided with a fastening element 311 and a fastening element 312, respectively. The fastening element 311 and the fastening element 312 are two disposed opposite zipper elements, hook-and-loop fasteners, fastening elements or other fasteners to connect or separate each other to close or open the opening portion 31. In the present embodiment, the cloth member 3 has a plurality of slots corresponding to the radial distribution of the plurality of support bars 2 so as to the plurality of support bars 2 are respectively inserted in the plurality of radial slots, so that the cloth member 3 is fixed to the plurality of support bars 2 and is expanded by the plurality of support bars to form a lampshade when the support bars are in the open-up position. Of course, the present invention is not so limited, and the cloth member 3 may be fixed to the plurality of support bars 2 in other manners. In addition, for the different specifications of the different lamps, the center of the cloth member 3 may be provided with a perforation 32, as shown in FIGS. 9C and 9D, in correspondence with the lamp L.

Figure 5A:
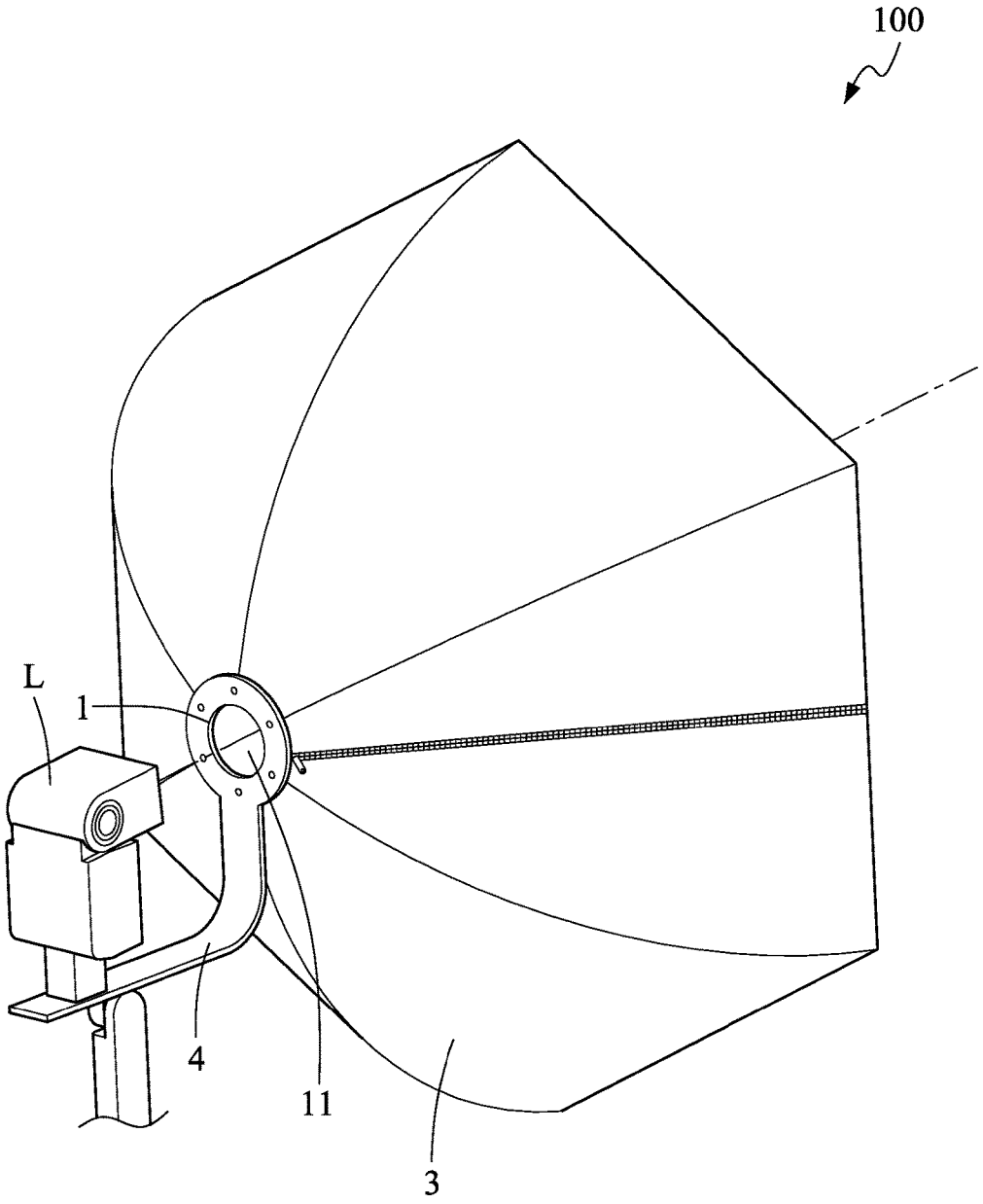
FIGS. 5A to 5E is a using schematic illustrating a lamp shade according to one embodiment of the present invention in which the respective pivot axes of the plurality of support bars are provided in parallel.
Figure 5B:
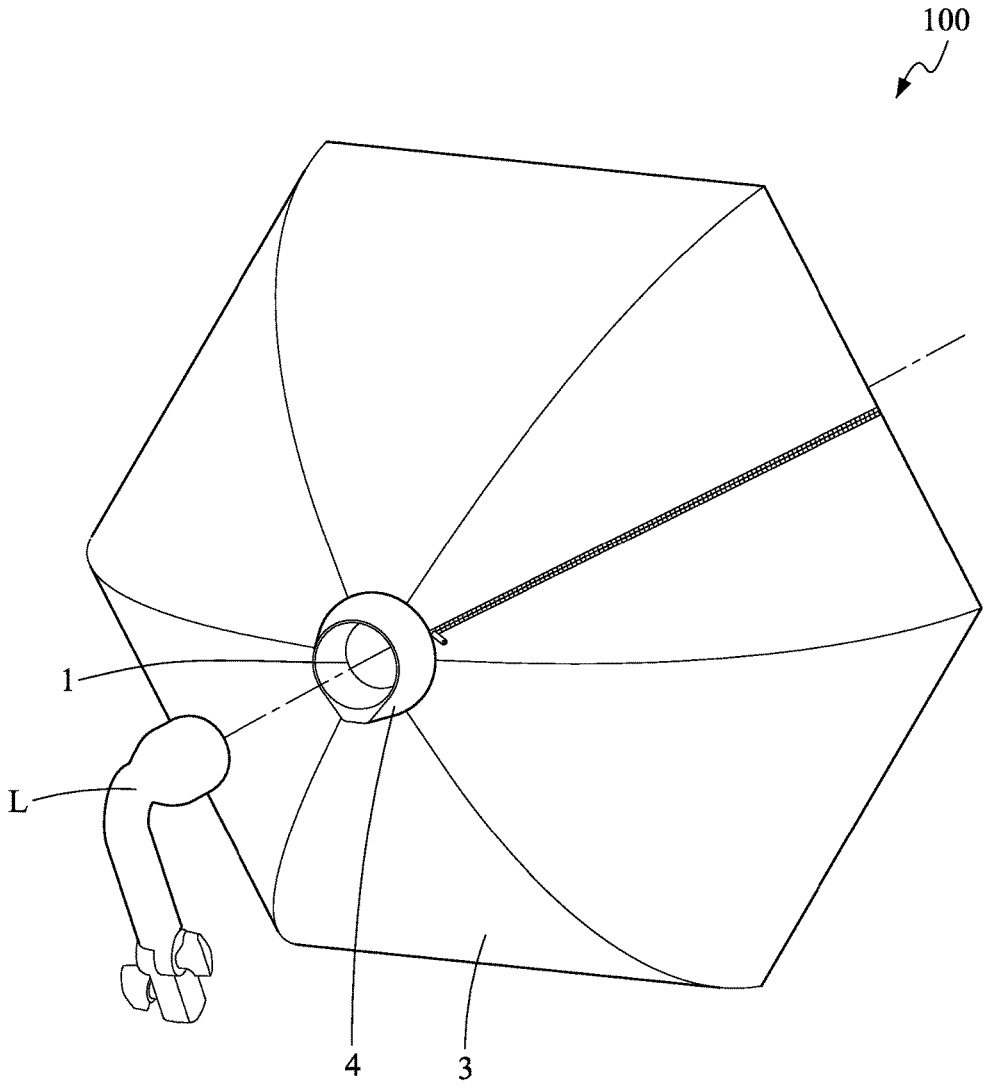
Figure 5C:
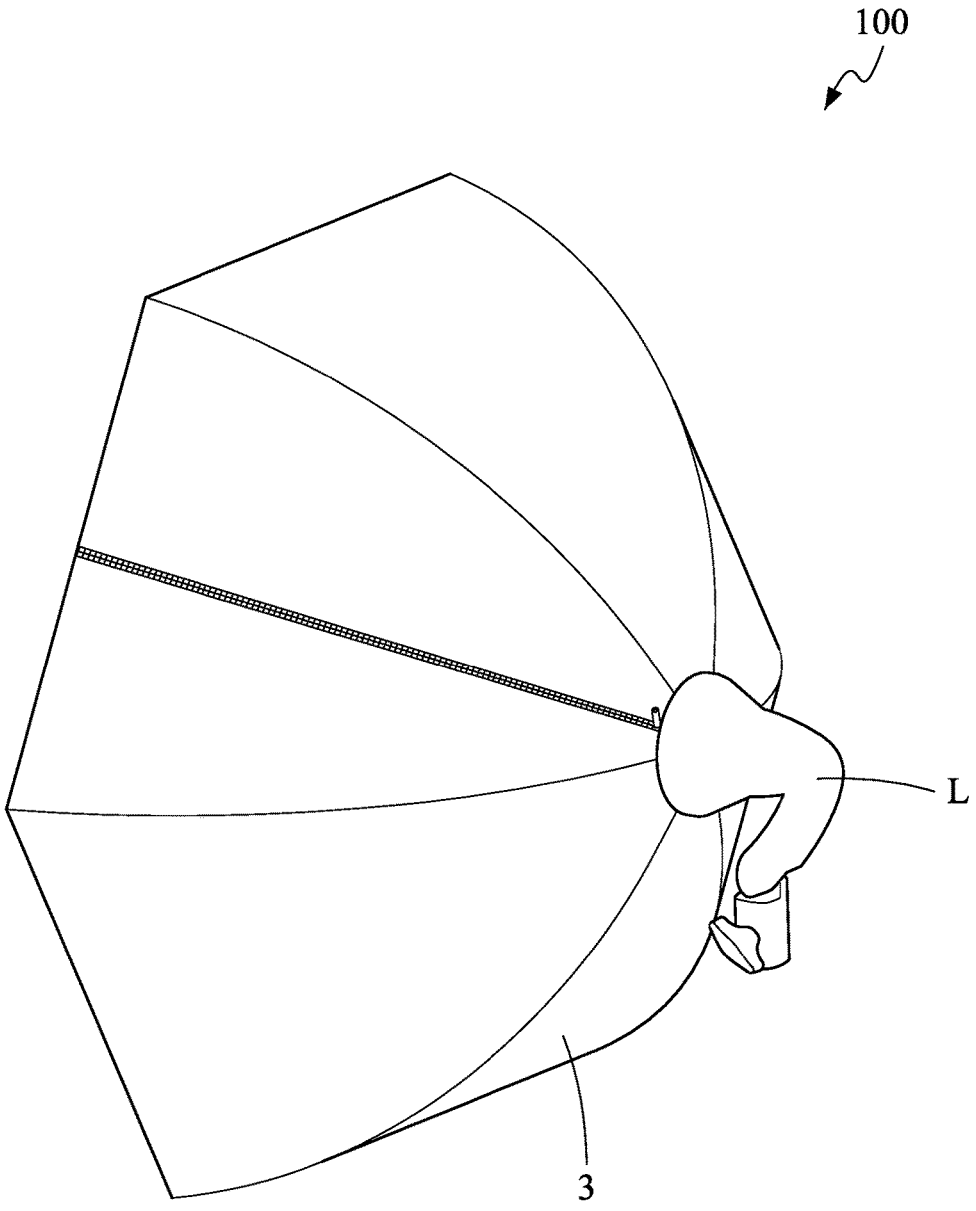
Figure 5D:
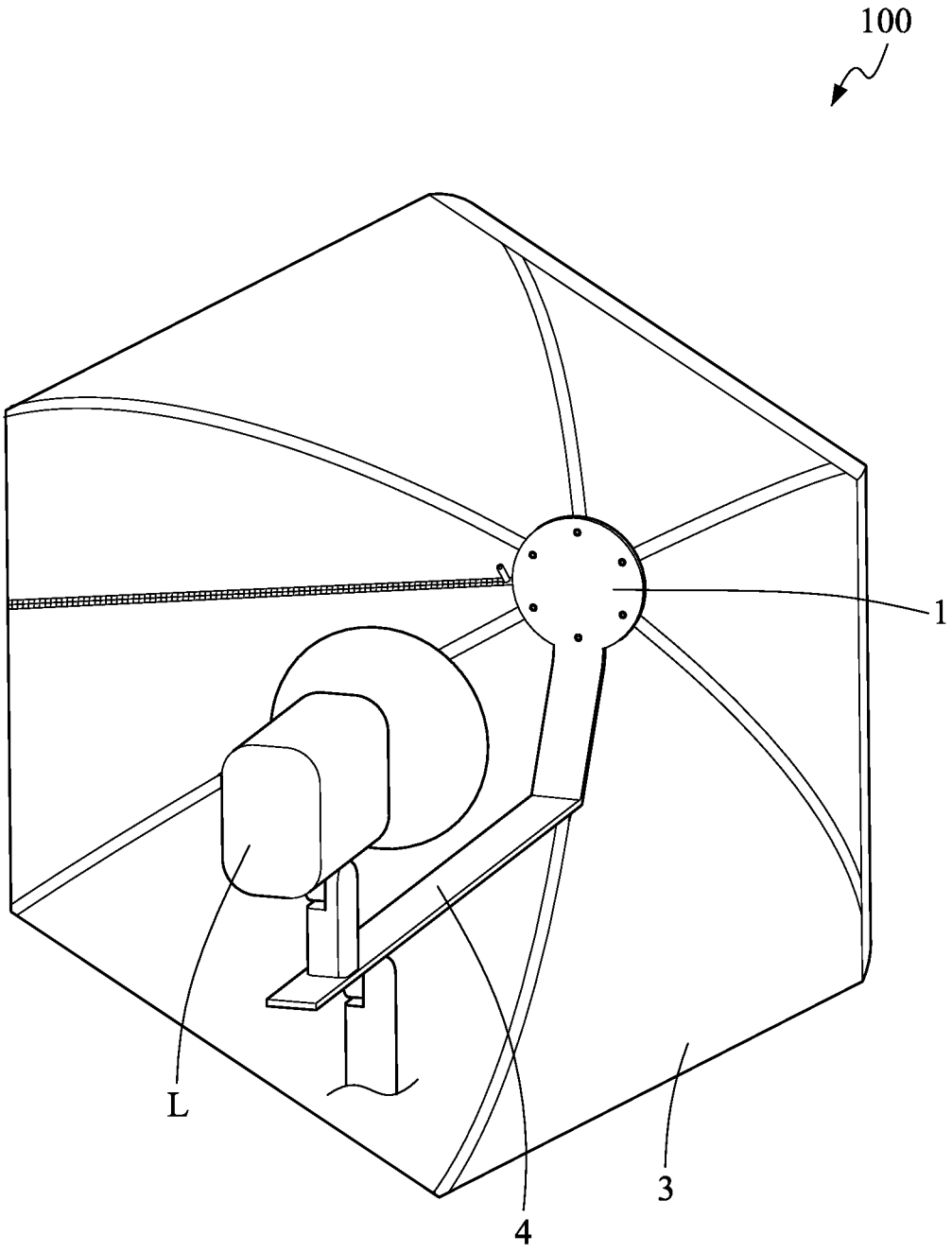
Figure 5E:
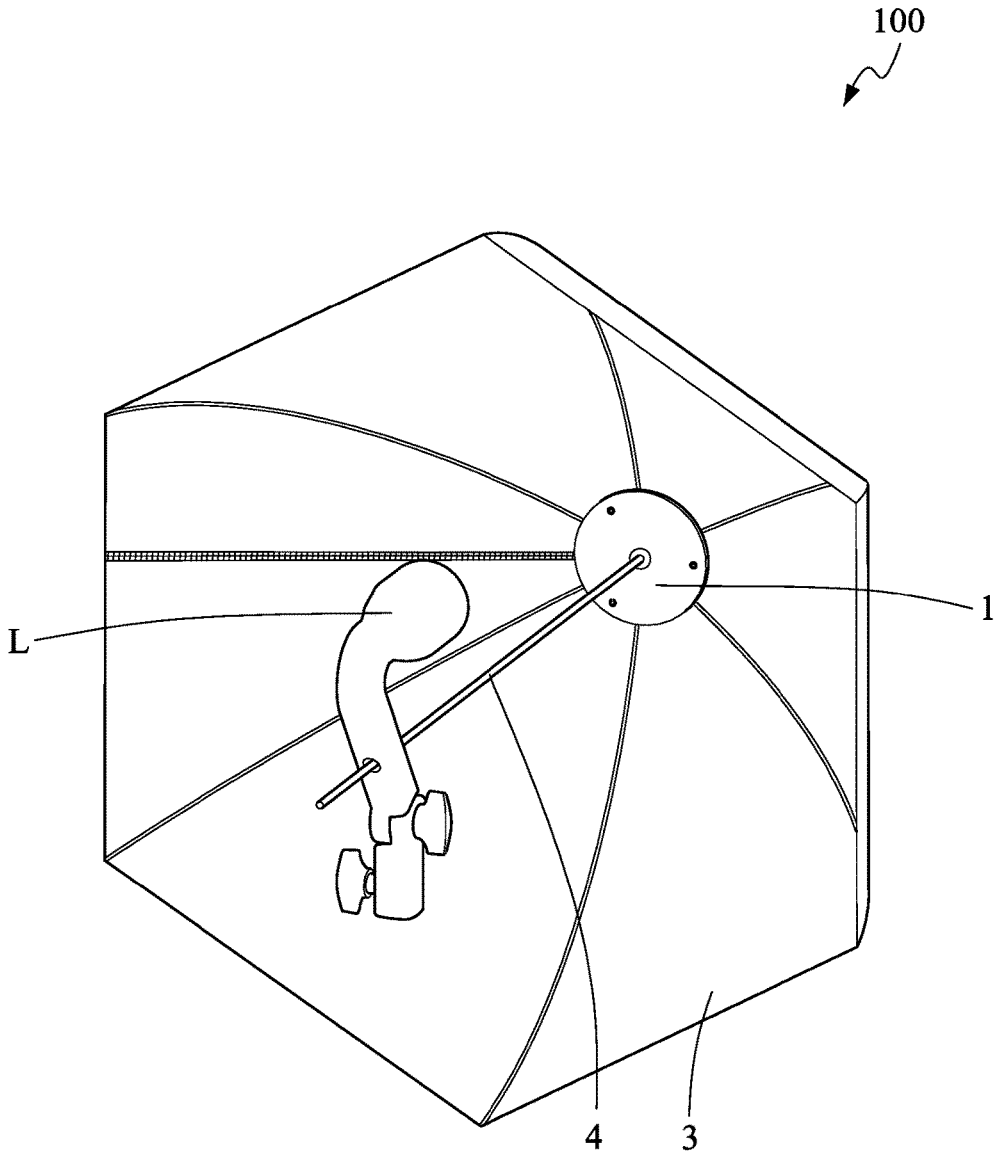
Figure 6:
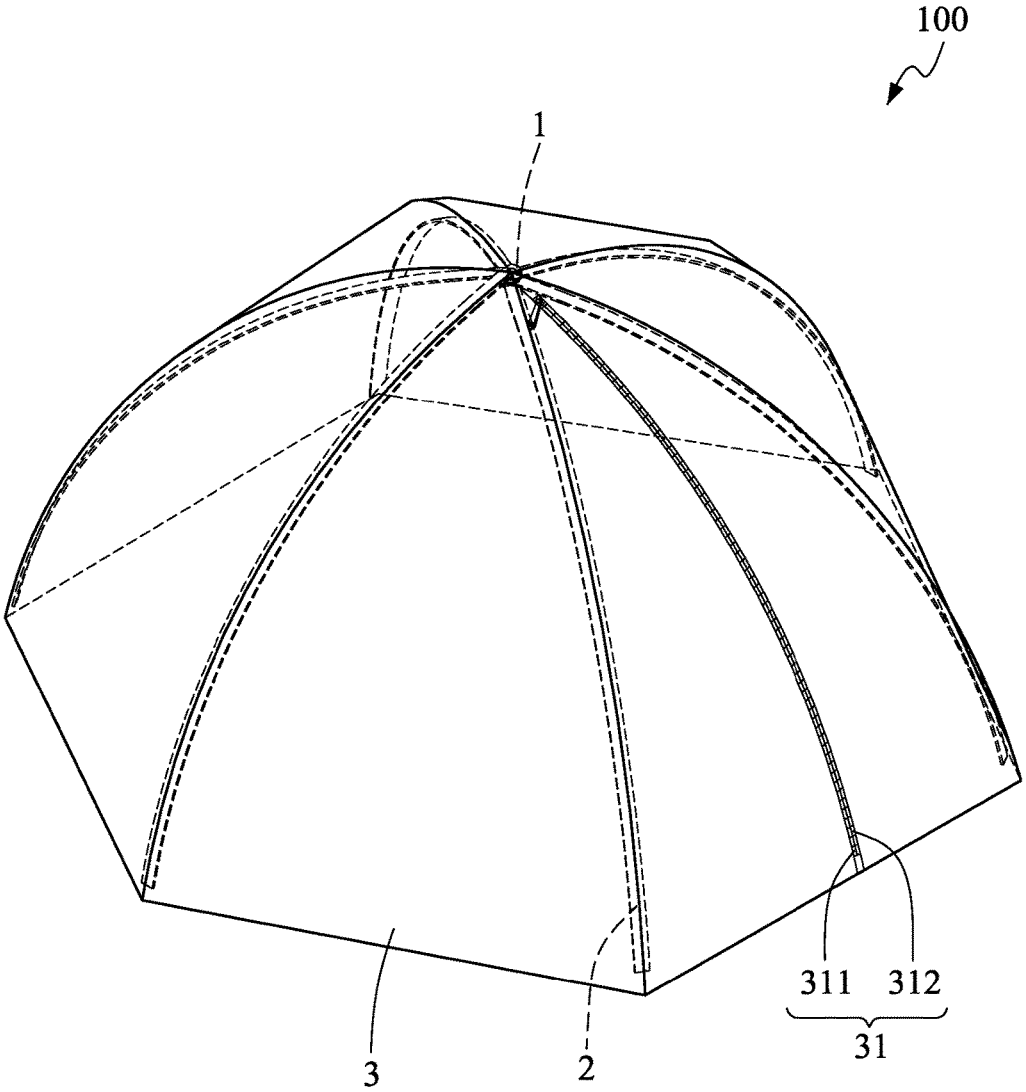
FIG. 6 is a schematic stereogram illustrating a lamp shade according to one embodiment of the present invention in which the pivot axes of the plurality of support bars are provided coaxially.

The lamp shade 100 of the present invention can be arranged on the lamp L to transmit or reflect the light of the lamp L, and there may be manners to arrange the lamp shade 100, which can varies with the needs of users for various applications. The lamp shade 100 may be arranged in front of or behind the lamp L and be connected to the lamp by means of a lamp connector 4, or may be arranged to the lamp L by other special means such as arranging the lamp shade 100 in the light range of the lamp without being in connection with the lamp L. In the embodiments of FIGS. 5A and 5B, the lamp connector 4 fixed at the peripheral edge of the lamp installation opening 11 of the multi-axial carrier 1 is provided for securing the lamp L sleeved by the lamp installation opening 11 to the multi-axial carrier 1. In another embodiment, as shown in FIGS. 5D and 5E, the lamp connector 4 fixed at the multi-axis carrier 1 is provided to be fastened to the lamp. In another embodiment, as shown in FIG. 5C, the multi-axis carrier 1 may also be directly connected to the lamp L, so that the lamp shade 100 is formed integrally with a portion of the lamp L to facilitate the entire assembly replace. In the embodiment of FIGS. 9A to 9D, the lamp connector 4 provided at the multi-axial carrier 1 is connected to the lamp in a different manner by means of the lamp connector 4.

With the structure described above, it can be seen that the lamp shape 100 can be quickly and simply switch to the open-up form and the folded form by pivoting the plurality of support bars 2 and the cloth member 3 together to the open-up position and closing the opening portion 31 of the cloth member 3 to switch the lamp shade 100 to the unfolded form, and by opening the opening portion 31 of the cloth 3 and pivoting the plurality of support bars 2 and the cloth 3 together to the folded position to switch the lamp shade 100 to the folded form, thereby achieving the object of convenience and practicality.

The above description is only an explanation of the preferred embodiments of the present invention. One having ordinary skill in the art can make various modifications according to the above description and the claims defined below. However, those modifications shall still fall within the scope of the present invention.

What is claimed is:

1. A lamp shade, comprising:

a multi-axis carrier;

a plurality of support bars, one end of each support bar being pivotally connected and pivotally rotated on a surface of the multi-axis carrier between an open-up position and a folded position, each support bar being pivotally rotated around a pivot axis, each pivot axis being perpendicular to the surface of the multi-axis carrier, all pivot axes being substantially parallel to each other or being coaxial such that each support bar is rotated around the surface of the multi-axis carrier, wherein, in the open-up position, the plurality of support bars are pivotally rotated as being radially distributed and, in the folded position, the plurality of support bars are pivotally rotated as being close to each other; and a cloth member, mounted on the plurality of support bars, having an opening portion which extends from a peripheral edge of the cloth member toward an inner center of the cloth member, and two corresponding sides of the opening portion being respectively provided with two fastening elements, the two fastening elements being configured to be connected or separated with each other to close or open-up the opening portion, wherein the cloth member is expanded by the plurality of support bars to form a lampshade when the support bars are in the open-up position and the fastening elements are connected, and the cloth member mounted on the plurality of support bars is folded by enabling the plurality of support bars to reversely pivotally move from the two corresponding sides of the opening portion so as to move the plurality of support bars from the open-up position to the folded position when the fastening portions are separated from each other to open the opening portion.

2. The lamp shade as claimed in claim 1, further comprising a lamp connector that connects with a lamp, the lamp connector is provided to be fixed on the multi-axis carrier.

3. The lamp shade as claimed in claim 1, wherein the respective pivot axes of the plurality of support bars are provided in parallel and surround a center of the multi-axial carrier, and side edges of the plurality of support bars get close to each other so as to get the plurality of support bars folded.

4. The lamp shade as claimed in claim 3, wherein the center of the multi-axial carrier is provided with a lamp installation opening where a lamp is installed.

5. The lamp shade as claimed in claim 3, further comprising a plurality of pivoting limiters protruding from a surface of the multi-axis carrier so as to resist against the support bars when the support bars are at the folded position and/or the open-up position and limit the support bars in positions between the folded position and the open-up position.

6. The lamp shade as claimed in claim 1, wherein the number of axis which is coaxial by the pivot axes of the plurality of support bars is at least one, and the axis which is coaxial by the pivot axes of the plurality of support bars is parallel to the other pivot axes.

7. The lamp shade as claimed in claim 1, wherein the pivot axes of the plurality of support bars are provided coaxially in such a manner that the plurality of support bars are vertically stacked to each other to pivotally connect to the multi-axial carrier, and wherein, in the folded position, upper surfaces and bottom surfaces of the plurality of support bars get close to each other so as to get the plurality of support bars closed.

8. The lamp shade as claimed in claim 1, wherein the multi-axial carrier is provided as a part of a lamp.

9. The lamp shade as claimed in claim 1, wherein each of the support bars includes a strengthening portion and a bar portion, one end of the strengthening portion is pivotally connected to the multi-axial carrier and the other end of the strengthening portion is sleeved on or in crimp connection with one end of the bar body portion to form the support bar together with the bar body portion.

10. The lamp shade as claimed in claim 1, wherein each of the support bars includes a strengthening portion and a bar body portion, one end of the strengthening portion is pivotally connected to the multi-axial carrier and the other end of the strengthening portion is sleeved on or in crimp connection with one end of the bar body portion to form the support bar together with the bar body portion, and said the other end of the bar body portion are collectively and pivotally connected to the multi-axial carrier together with the strengthening portion.

* * * * *